US009133634B2

(12) United States Patent
Brinkmann

(10) Patent No.: US 9,133,634 B2
(45) Date of Patent: Sep. 15, 2015

(54) SCAFFOLDING SYSTEM, AS WELL AS A COUPLING, A LEDGER AND A STANDARD

(75) Inventor: Franciscus Jozef Leonardus Hubertus Brinkmann, Budel (NL)

(73) Assignee: Scafom International B.V., Budel (NL)

( * ) Notice: Subject to any disclaimer, the term of this patent is extended or adjusted under 35 U.S.C. 154(b) by 407 days.

(21) Appl. No.: 13/384,296

(22) PCT Filed: Jul. 15, 2010

(86) PCT No.: PCT/NL2010/050459

§ 371 (c)(1),
(2), (4) Date: Apr. 2, 2012

(87) PCT Pub. No.: WO2011/008094

PCT Pub. Date: Jan. 20, 2011

(65) Prior Publication Data

US 2012/0181111 A1 Jul. 19, 2012

(30) Foreign Application Priority Data

Jul. 15, 2009 (NL) ..... 2003206

(51) Int. Cl.

| | |
|---|---|
| ***E04G 7/32*** | (2006.01) |
| ***E04G 7/02*** | (2006.01) |
| ***E04G 7/22*** | (2006.01) |
| ***E04G 7/30*** | (2006.01) |

(52) U.S. Cl.

CPC .. *E04G 7/32* (2013.01); *E04G 7/02* (2013.01); *E04G 7/22* (2013.01); *E04G 7/307* (2013.01)

(58) Field of Classification Search

CPC ..... E04G 7/02; E04G 7/06; E04G 7/12; E04G 7/14; E04G 7/16; E04G 7/22; E04G 7/24; E04G 7/302; E04G 7/306; E04G 7/32; E04G 7/34; E04G 1/12

USPC ..... 182/178.1, 179.1, 186.7, 186.8

See application file for complete search history.

(56) References Cited

U.S. PATENT DOCUMENTS

| | | | | |
|---|---|---|---|---|
| 3,092,407 | A * | 6/1963 | Blonder | 403/191 |
| 4,566,819 | A * | 1/1986 | Johnston | 403/385 |
| 5,427,465 | A * | 6/1995 | Sato | 403/49 |
| 6,168,345 | B1 * | 1/2001 | Legge | 403/385 |
| 6,481,912 | B2 * | 11/2002 | Shih | 403/49 |
| 6,575,652 | B2 * | 6/2003 | Krauss | 403/49 |

(Continued)

FOREIGN PATENT DOCUMENTS

| | | |
|---|---|---|
| FR | 1429423 | 5/1966 |
| FR | 2119719 | 8/1972 |

(Continued)

*Primary Examiner* — Colleen M Chavchavadze

(74) *Attorney, Agent, or Firm* — Banner & Witcoff, Ltd.

(57) ABSTRACT

A scaffolding system provided with standards each with an imaginary standard longitudinal central axis, first ledgers each with two extremities, first ledger couplings each connected at the extremity of a first ledger to the first ledger and which are configured for connecting the extremity of the first ledger to a standard, supporting projections which, viewed in the direction of the standard longitudinal central axis, are provided at regular distances on the outer surface of a said standard, wherein with a first ledger in a condition coupled to a standard, the first ledger coupling of the respective first ledger rests on a said supporting projection. Also, a coupling, a ledger and a standard intended for such a scaffolding system are disclosed.

11 Claims, 9 Drawing Sheets

(56) References Cited

U.S. PATENT DOCUMENTS

| | | | | |
|---|---|---|---|---|
| 6,786,302 | B2 * | 9/2004 | Liew et al. | 182/186.8 |
| 7,147,398 | B2 * | 12/2006 | Liew et al. | 403/169 |
| 7,448,819 | B1 * | 11/2008 | Fu | 403/49 |
| 2002/0106237 | A1 * | 8/2002 | Rogers | 403/49 |
| 2002/0141811 | A1 * | 10/2002 | Shih | 403/49 |
| 2009/0249591 | A1 * | 10/2009 | Melic | 24/517 |

FOREIGN PATENT DOCUMENTS

| | | |
|---|---|---|
| GB | 1185169 | 3/1970 |
| JP | 10131475 | 5/1998 |

* cited by examiner

SCAFFOLDING SYSTEM, AS WELL AS A COUPLING, A LEDGER AND A STANDARD

CROSS-REFERENCE TO RELATED APPLICATIONS

This application is a U.S. National Stage application under 35 U.S.C. §371 of International Application PCT/NL2010/050459 (published as WO 2011/008094 A1), filed Jul. 15, 2010, which claims priority to Application NL 2003206, filed Jul. 15, 2009. Benefit of the filing date of each of these prior applications is hereby claimed. Each of these prior applications is hereby incorporated by reference in its entirety.

TECHNICAL FIELD

The invention relates to a standard for a scaffolding system, as well as a scaffolding system provided with standards and ledgers and a coupling for attaching ledgers to standards.

BACKGROUND

Different types of scaffolding systems are known. US patent publication U.S. Pat. No. 4,044,523 discloses a scaffolding system, provided with standards and ledgers. The standards are provided at regular distances with annular flanges in which cut-outs are provided. The ledgers are provided at their extremities with couplings having a slot extending in horizontal direction, in which an annular flange of a standard can be received. The coupling is further provided with a wedge which can be inserted through a cut-out into the flange and, by striking the wedge into place a coupling between a ledger and a standard can be rapidly realized. A drawback of this known scaffolding system is the presence of the annular flanges on the standards. These annular flanges complicate storage of the standards. The fact is that when the standards are stacked onto each other, the annular flanges provided at regular distances will complicate the relative sliding movement of the pipes so that taking such a standard from such a stack of standards is laborious. Furthermore, the presence of a number of annular flanges on a standard leads to a considerable increase in weight of the standard. Standards are often 2-2.5 meters long and every 500 mm an annular flange is attached to the standards. Due to the increase of the weight of the standard, the total working length of the standard is limited because with greater length, the total weight is no longer manageable for the scaffolding builder. In practice, the system disclosed in this patent is indicated as ring system.

Also known from practice is the so-called cup system. Such a cup system is described in European patent application EP-0 409 051 A2. In particular FIG. 9 of this publication clearly shows the design of this cup system. On each standard, at regular distances, two cups are provided. The lower cup is fixedly connected to the standard and the top cup is movably connected to the standard. The ledgers are provided at the extremities with flanges that can be hooked into the cups. The top cup has an upper surface that inclines upward and the standard is provided with projections designed for cooperation with the upward inclining top surface. Through rotation of the top cup, the top cup can be clamped-in in downward direction between the ledger and the projection. Thus, a ledger can be rapidly and efficiently fixed. For the cup system, in principle, the same drawbacks hold true as for the above-described ring system.

GB 1,185,169 shows, in FIGS. 9-16, different variants of standards. These known standards are provided with welded-on brackets or with bolts mounted therein on which a ledger can be placed. For these brackets and bolts the same drawbacks hold true as mentioned hereinabove.

Yet another drawback, not yet mentioned, of the known systems is that the rings, cups, brackets or bolts are always provided on the standard at quite a large distance from each other. A customary distance may be 500 mm. This distance is a compromise between weight and flexibility. From a viewpoint of flexibility, it would be advantageous to provide the rings or cups at a smaller mutual distance, so that there is a greater freedom of choice with respect to the level at which the ledgers can be connected with the standards. However, from a point of view of weight reduction, a greater distance is of advantage. Apparently, 500 mm is an acceptable compromise. Advantages of the known systems are that several ledgers can be connected at the same level to a standard and that such a connection can be realized very rapidly by a scaffolding builder. Another advantage is that the ledgers are always connected to the standards at fixed positions so that a regular framework can be obtained in a simple manner.

The object of the invention is to obviate or alleviate the above-described drawbacks.

SUMMARY OF THE INVENTION

More particularly, the object of the invention is to provide a standard of a scaffolding system which can be of relatively light design while with it, still a scaffolding system with a high degree of flexibility can be provided because the ledgers can be connected to the standards at many different levels but still at fixedly defined positions.

According to a first aspect of the invention, to this end, a standard for the purpose of a scaffolding system is provided, which standard is provided with an imaginary standard longitudinal central axis ($L_s$), and is further provided with:

- a cylindrical tube wall concentric with the standard longitudinal central axis;
- supporting projections which, viewed in the direction of the standard longitudinal central axis, are provided at regular distances on the outside surface of a standard mentioned, wherein the supporting projections are formed through plastic deformation of the tube wall.

To this end, according to a further aspect of the invention, a scaffolding system is provided, which is provided with:

- first ledgers, each with an imaginary ledger longitudinal central axis and two extremities;
- first ledger couplings which are each connected at the extremity of a first ledger to the first ledger;
- standards as defined hereinabove;

wherein the ledger couplings are configured for connecting the extremity of the first ledger to a standard, and wherein, with a first ledger in a condition coupled to a standard, the first ledger coupling of the respective first ledger rests on a supporting projection.

According to a further aspect, the invention also provides a ledger coupling intended for such a scaffolding system, which ledger coupling is provided with:

- a foot having a first side designed for fixed connection with an extremity of a ledger associated with the coupling, while a second side of the foot located opposite the first side forms a foot support surface for abutment against an outer surface of a standard;
- a coupling hook which is connected by a first end with the foot and which forms a coupling hook support surface which, together with the foot support surface, defines a substantially semicircular standard receiving surface having a radius which substantially corresponds to the diameter of a standard, while the substantially semicircular standard receiving surface defines a standard receiving space which has a central axis that, with the coupling mounted on a standard, substantially coincides with the standard central axis, while the coupling hook together with the foot defines a standard inlet via which a standard can be introduced into the standard receiving space;

a locking element which is connected hingedly about a pivot to the coupling hook, wherein the pivot is parallel to the central axis of the standard receiving space, wherein the locking element has a locking position in which the standard inlet is blocked by the locking element, and wherein the locking element has a releasing position in which the standard inlet is released for letting a standard in or taking a standard out of the standard receiving space;

a wedge which is slideably connected to the coupling hook and which in a securing position, engages the locking element and holds this locking element in the locking position;

a first wedge recess in the coupling hook adjacent a second extremity of the coupling hook which is remote from the extremity of first coupling hook connected to the foot, wherein the wedge is slideably but not removably received in the wedge recess; and a second wedge recess in the coupling hook adjacent the first extremity of the coupling hook, which second wedge recess is configured for allowing the passage of a wedge of a second, corresponding coupling of a second ledger which is connected to the standard at the same level.

According to a further aspect of the invention, a ledger intended for such a scaffolding system is provided, wherein the ledger is fixedly connected at at least one extremity thereof with a first side of the foot of the ledger coupling.

Since on a standard only supporting projections and, in one embodiment, optionally, orientation projections need to be provided, the standard can be of particularly light design. As the projections can be formed through plastic deformation of the tube wall, the presence of the projections does not even lead to any increase of weight. It is therefore possible to choose the distance between the successive supporting projections on the standard to be relatively small, for instance 200 mm, so that ledgers can be provided at many more desired levels than was customary up to now, while still, the ledgers maintain fixedly defined positions relative to the standards. This is highly beneficial to the flexibility of the scaffolding system. With the scaffolding system according to the invention, the objective of enhanced flexibility and weight reduction with regard to the known scaffolding systems is therefore realized, as the presence of annular flanges or cups that are connected to the standards can be completely abandoned. The standards need only be provided with supporting projections formed through plastic deformation of the tube walls and, optionally, with orientation projections. Such standards are also usable with scaffolding systems whose ledgers are not provided at their extremities with couplings, but where the ledgers are connected to the standards with the aid of separate cross connections. Cross connections are known in many types. Normally, the connection with the standard and the cross connection is realized based completely on clamping force. In order to generate sufficient clamping force, the cross connections are to be of heavy design. As a result of the presence of the supporting projections, it is no longer necessary to rely on clamping force only for vertical load on the cross connection. The fact is that owing to the supporting projections it is impossible for the cross connection to slide downwards. As a result thereof, when using standards according to the invention, the cross connections can be of much lighter design. Instead of cross connections in the order of 1 kg, with scaffolding tubes according to the invention, cross connection with a weight in the range of 200-500 g can suffice. This is highly beneficial to the comfort of the scaffolding builder. As the weight of the standards remains unchanged with respect to the conventional smooth scaffolding tubes, and the weight of the cross connections can be considerably less than with conventional scaffolding systems, the total weight of a scaffolding construction can be considerably less while the strength of the scaffolding construction remains the same. A scaffolding system with the same strength but less own weight can therefore still bear a larger effective load.

The special coupling allows a rapid connection of ledgers with standards and in one embodiment of the coupling, it is also possible that different ledgers can be connected in line with a standard as a result of the special configuration of the above-described coupling.

Other aspects and advantages of the invention will be further elucidated hereinafter on the basis of an exemplary embodiment with reference to the drawing.

DETAILED DESCRIPTION

The Figures show an example of an embodiment of a scaffolding tube, a ledger, a coupling and a scaffolding system according to the invention.

Figure 1:
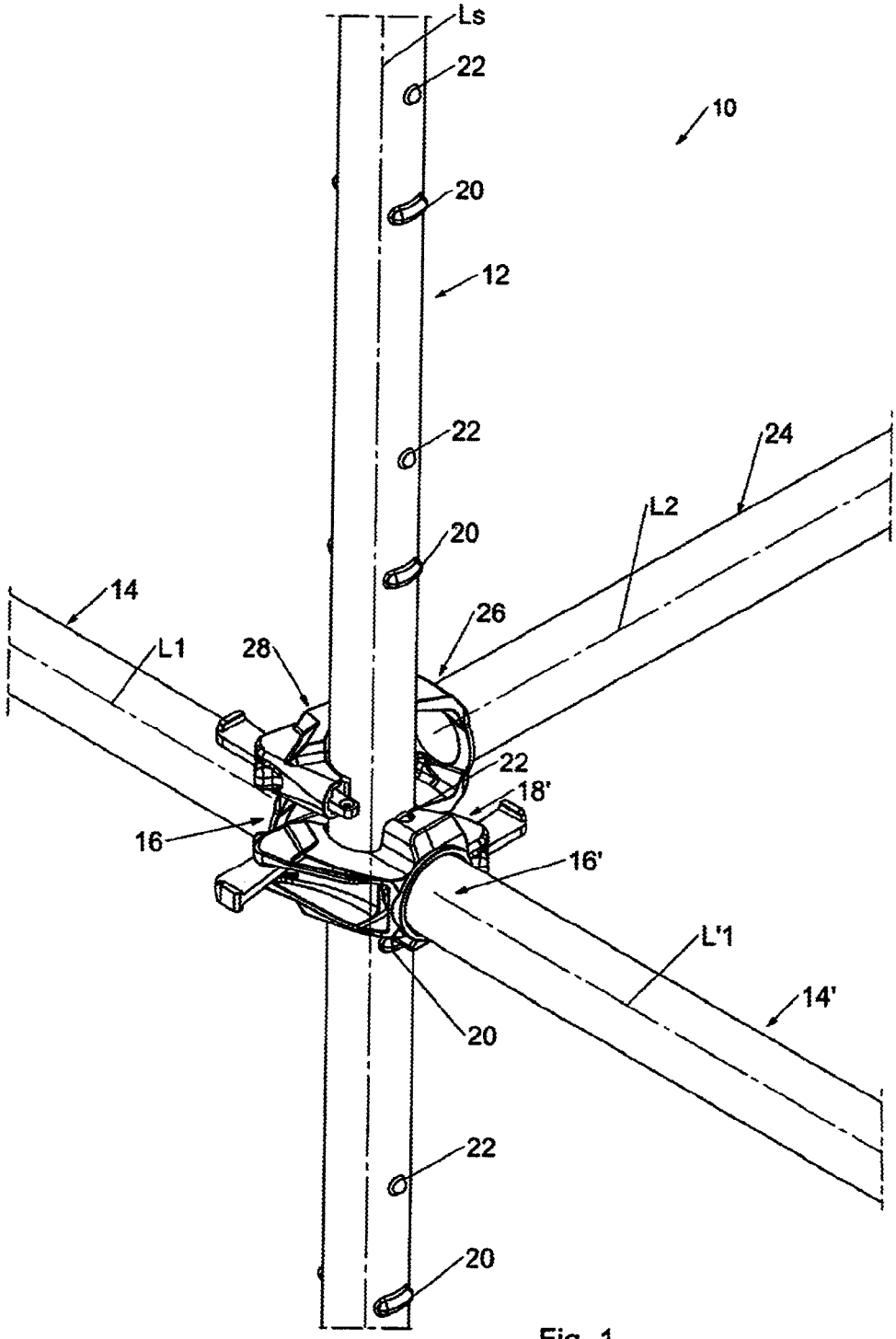
FIG. 1 shows a perspective view of a node of an exemplary embodiment of the scaffolding system.
Figure 2:
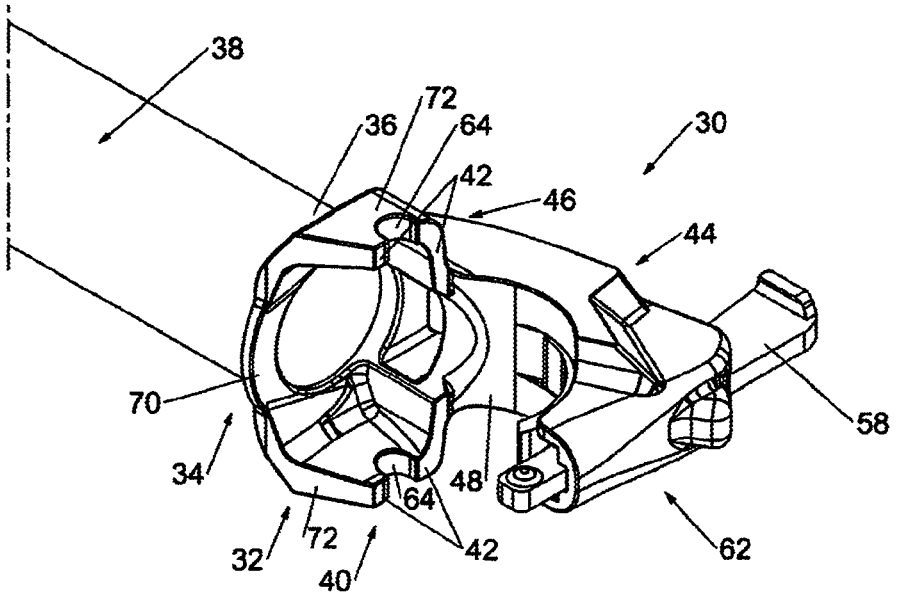
FIG. 2 shows an exemplary embodiment of a ledger with ledger coupling in perspective view.
Figure 3:
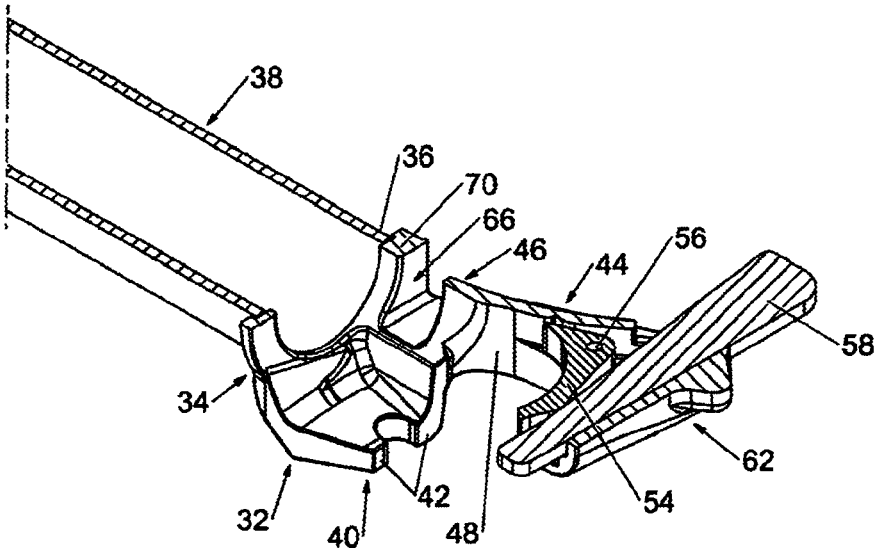
FIG. 3 shows the exemplary embodiment represented in FIG. 2 in perspective cross-section.
Figure 4:
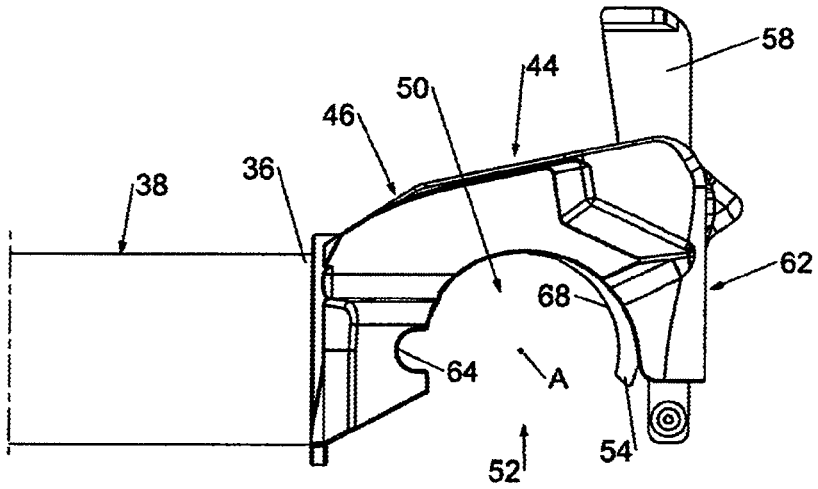
FIG. 4 shows the exemplary embodiment represented in FIG. 2 in top plan view.
Figure 5:
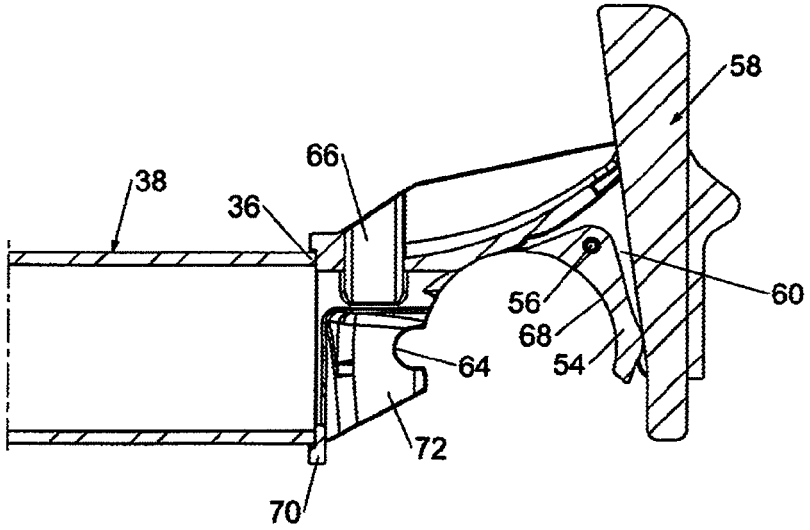
FIG. 5 shows the exemplary embodiment of FIG. 2 in cross section.
Figure 6:
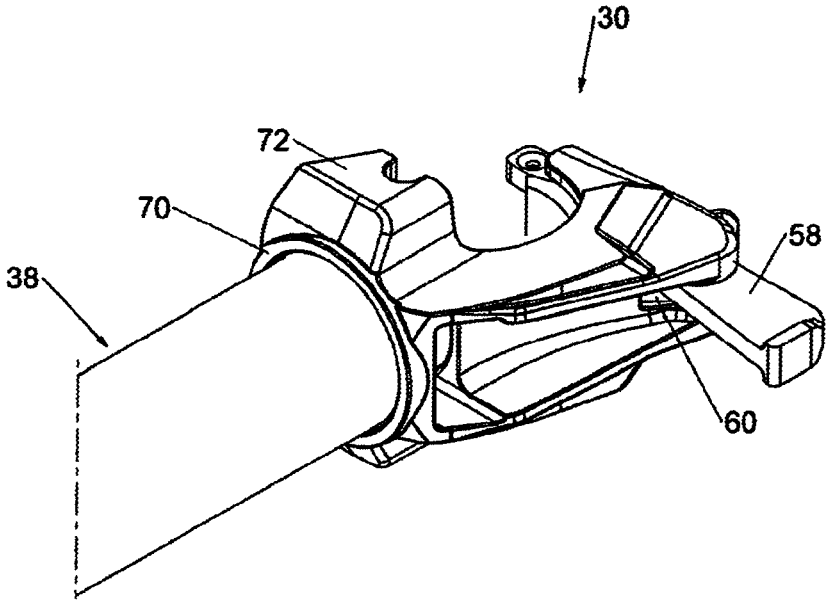
FIG. 6 shows the exemplary embodiment of FIG. 2 in perspective view from a different side.
Figure 7:
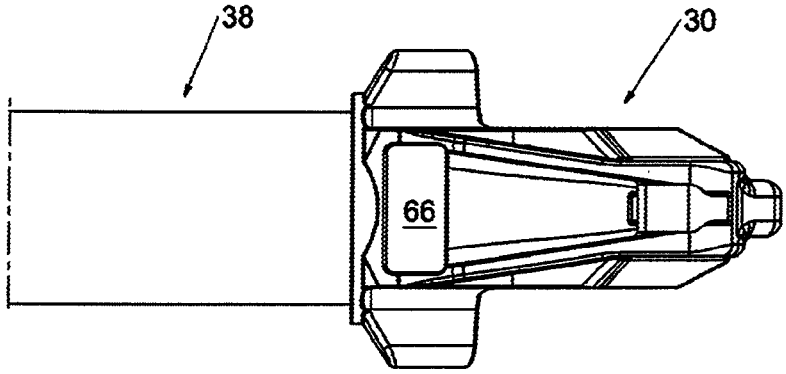
FIG. 7 shows a side view of the exemplary embodiment of FIG. 2.
Figure 8:
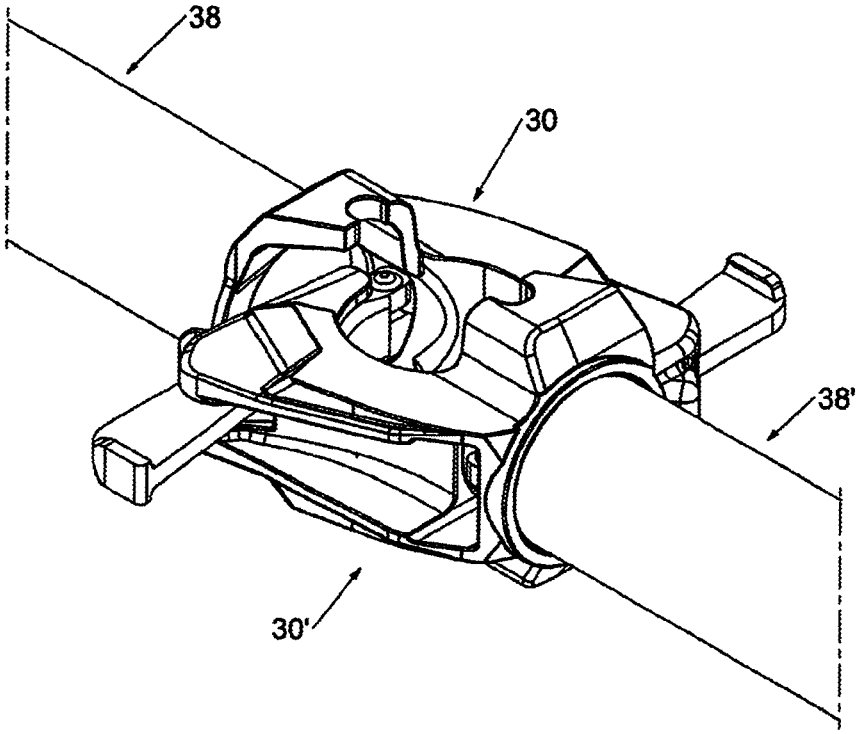
FIG. 8 shows two ledgers in line with each other with couplings.
Figure 9:
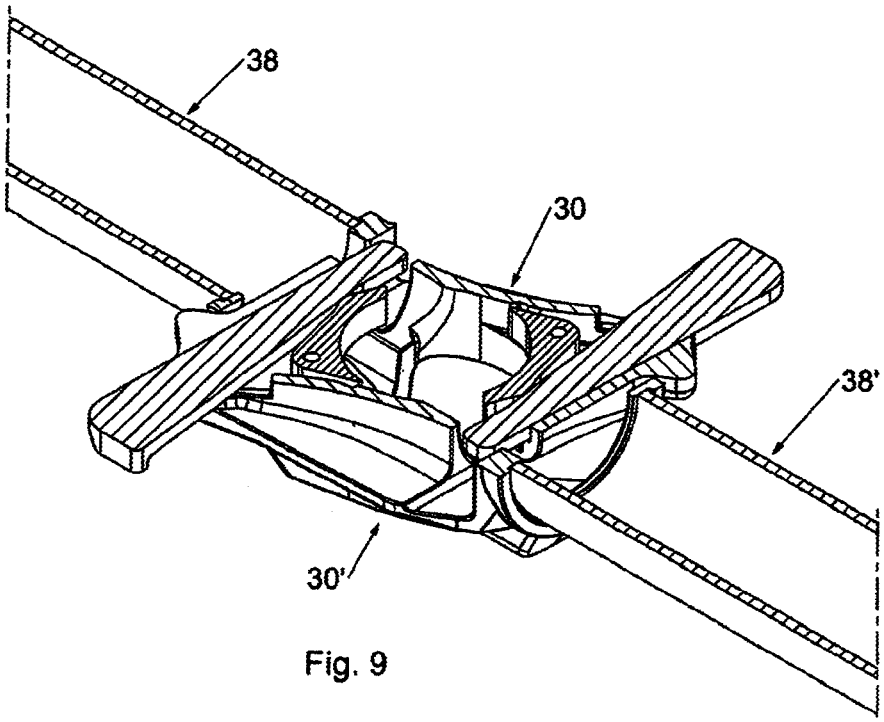
FIG. 9 shows the assembly shown in FIG. 8 in perspective view in cross section.
Figure 10:
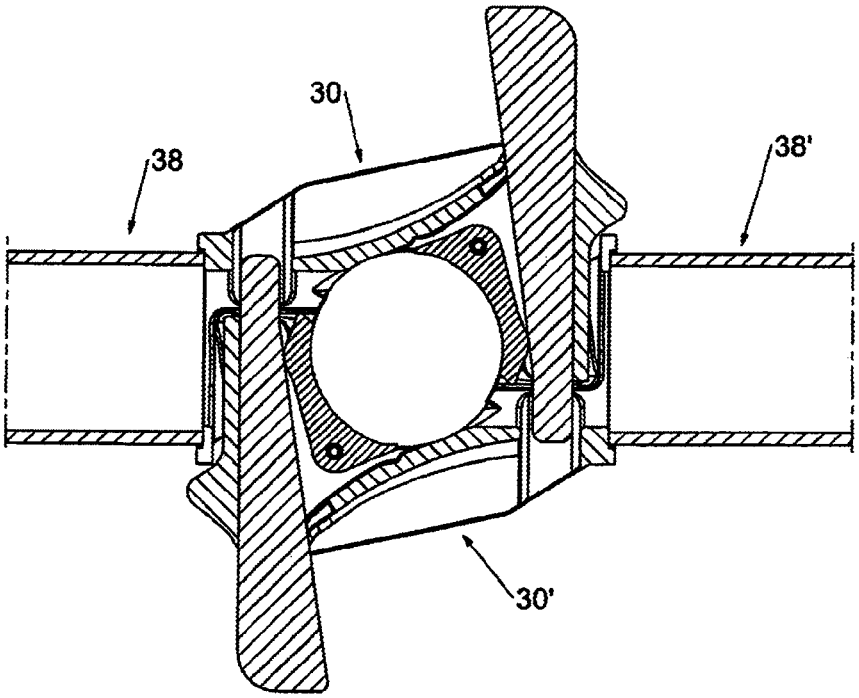
FIG. 10 shows the assembly shown in FIG. 8 from above in cross section.

FIG. 1 shows a node of such a scaffolding system wherein in this Figure, the node comprises a standard 12, two first ledgers 14, 14', and a second ledger 24. A node can also be formed by a standard and a single first ledger or by a standard and two first ledgers, or by a standard with a first ledger and two second ledgers or a standard with two first ledgers 14, 14' and two second ledgers 24, 24'.

The standards 12 of the scaffolding system 10 each have an imaginary standard longitudinal central axis $L_s$. The first ledgers 14, 14' each have an imaginary ledger longitudinal central axis L1 and two extremities 16, 16'. Each first ledger 14, 14' is provided on at least one extremity 16, 16' with a first ledger coupling 18, 18'. Although not necessarily, in general, each first ledger 14, 14' will be provided on both extremities with a first ledger coupling 18, 18'. The first ledger couplings 18, 18' are configured for connecting the extremity 16, 16' of the first ledger 14, 14' with a standard 12. The standard 12 is provided with supporting projections 20 which are provided, viewed in the direction of the standard longitudinal central axis $L_s$, at regular distances on the outside surface of the standard 12. In the present exemplary embodiment, the supporting projections 20 are each time provided diametrically opposite each other on two sides of the standard 12. With a first ledger 14, 14' in a condition coupled to a standard 12, the first ledger coupling 18, 18' of the respective first ledger 14, 14' rests on a supporting projection 20.

In one embodiment, of which an example is shown in FIG. 1, the standards 12 of the scaffolding system can be provided with orientation projections 22 which, viewed in the direction of the standard central axis $L_s$, are provided at regular distances on the outside surface of the standard 12 and which are each associated with an associated supporting projection 20. As will become clear later with reference to FIGS. 2-10, each first ledger coupling 18, 18' is provided with at least one orientation recess 64. With a first ledger 14, 14' in a condition coupled to the standard 12, the rotational position of the first ledger coupling 18, 18' relative to the standard 12 is defined through reception of the orientation projection 22 on the standard 12 in the at least one orientation recess 64 of the first ledger coupling 18, 18'. Thus, it is realized in a simple manner that all first ledgers 14, 14' on the different levels of the scaffolding system 10 extend in the same direction.

The supporting projections 20 and the optionally present orientation projections 22 are provided in the standard through plastic deformation of the standard wall. Thus, the presence of such supporting projections 20 and orientation projections 22 does not lead to increase of weight of the standard 12. As the supporting projections 20 and, optionally, the orientation projections 22 project outside the profile of the standard only to a limited extent, the standards 12 can be removed from a stack of standards 12 in a simple manner. This is contrary to, for instance, standards of a ring scaffolding system or a cup scaffolding system. As the supporting projections 20 and the optional orientation projections 22 do not lead to weight increase of the standard 12, they can be provided at a smaller distance from each other viewed in the direction of the standard central axis $L_s$. This offers an improved flexibility with respect to the levels on which first ledgers 14, 14' can be connected to the standard 12.

As already indicated hereinabove, in one embodiment, of which an example is shown in FIG. 1, the scaffolding system 10 can also comprise second ledgers 24. The second ledgers 24 each have an imaginary ledger longitudinal central axis L2 and two extremities 26. Further, to at least one extremity 26 of the second ledger 24, a second ledger coupling 28 is connected which is configured for connecting the extremity 26 of the second ledger 24 to a standard 12. With a second ledger 24 in a condition coupled to a standard 12, the second ledger coupling 28 rests on a first ledger coupling 18, 18' of a first ledger 14. Although not required, it is advantageous from a point of view of production when the first ledger couplings 18 are of the same design as the second ledger couplings 28. This is furthermore beneficial to the exchangeability of first and second ledgers 14, 24. In the present exemplary embodiment, the first ledgers 14, 14' form longitudinal ledgers and the second ledgers 24 form transverse ledgers. However, a reverse configuration of the scaffolding system is possible too.

Figure 11:
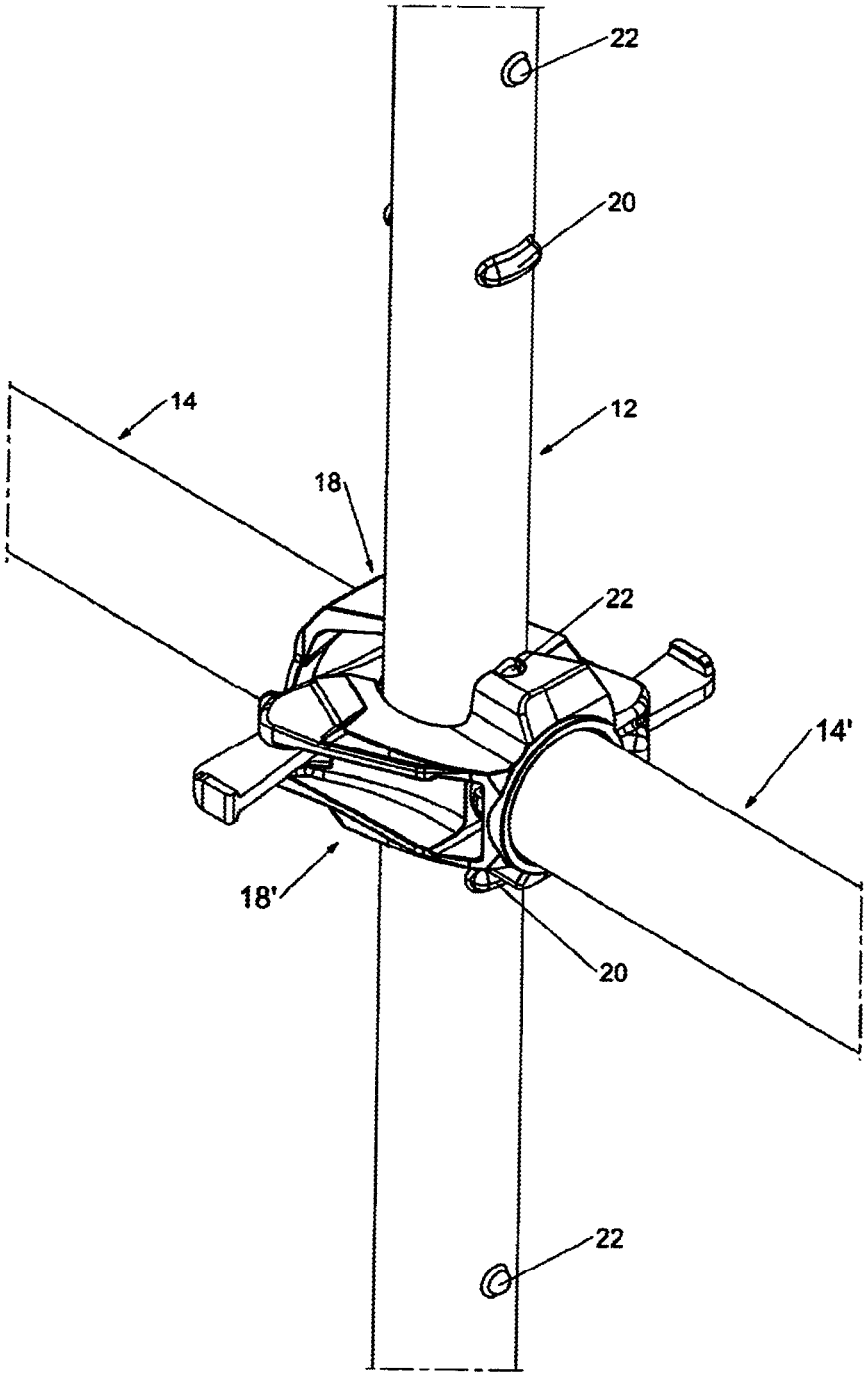
FIG. 11 shows a node of a standard with two ledgers.
Figure 12:
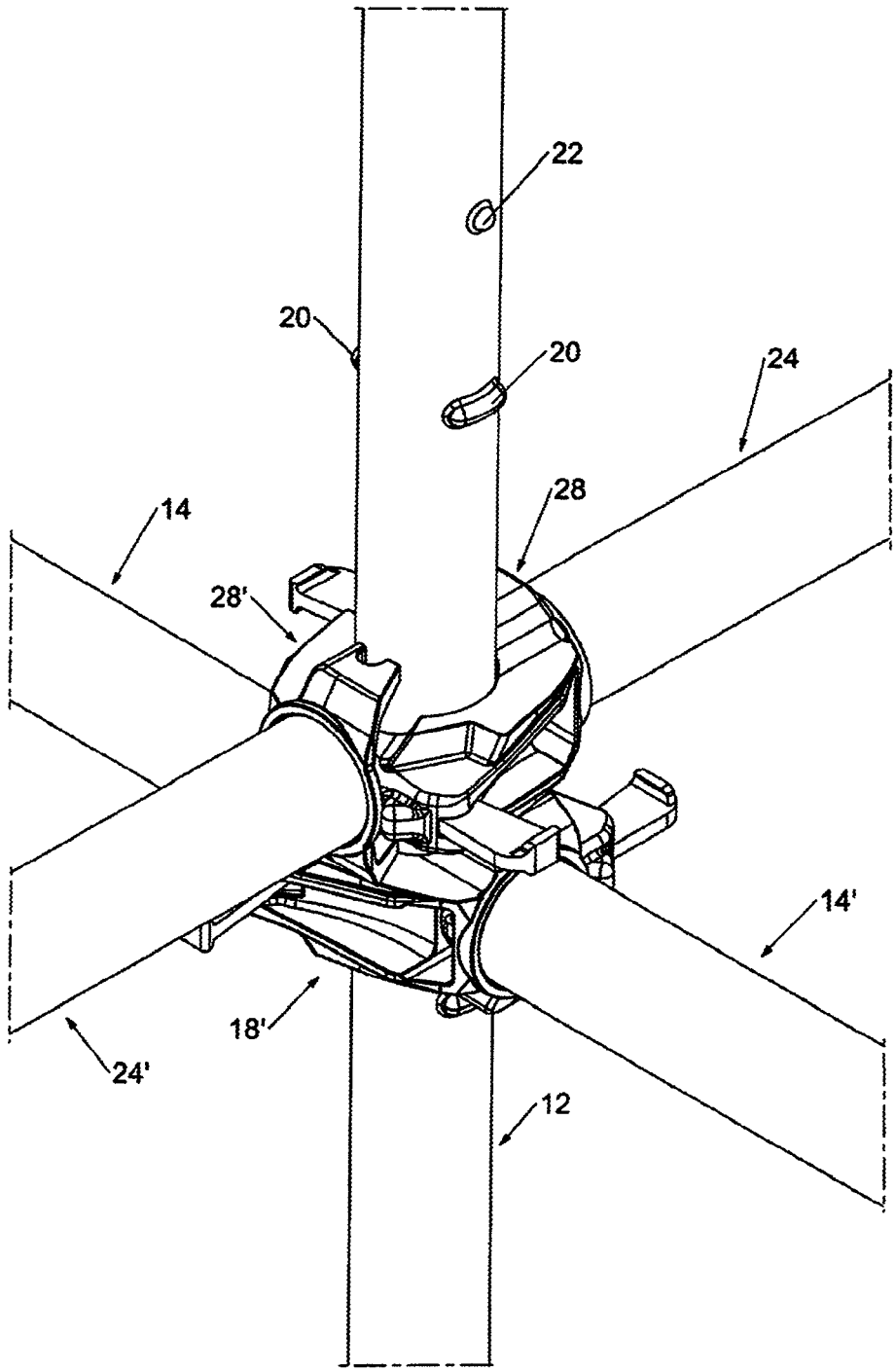
FIG. 12 shows a node of a standard with two first ledger tubes and two second ledgers.

In one embodiment, of which an example is shown in FIGS. 1, 8, 11, 12 and 13, the first ledger couplings 18, 18' are designed such that the first ledgers 14, 14' can be connected at the same level to a joint standard 12 such that the longitudinal central axes L1 of the two first ledgers 14, 14' are in line with each other. Needless to say, such a possibility also presents itself for the second ledgers 24, 24' as represented in FIG. 12. In the example represented in FIG. 12 this is realized in that the second ledger couplings 28 are of the same type as the first ledger couplings 18.

An exemplary embodiment of the above-mentioned ledger coupling that will now be indicated with reference numeral 30 is described in the following with reference to FIGS. 2-10. The exemplary embodiment of the ledger coupling 30 which is shown in these Figures is intended for a scaffolding system 10 as described above. The ledger coupling 30 comprises a foot 32 which has a first side 34 that is designed for a fixed connection to an extremity 36 of the ledger 38 associated with the coupling 30. A foot support surface 42 which lies at a second side 40 of the foot opposite the first side 34, serves for abutment against an outside surface of the standard 12. The coupling 30 further comprises a coupling hook 44 which is connected by a first end 46 to the foot 32. The coupling hook 44 forms a coupling hook support surface 48 which, together with the foot support surface 42, defines a substantially semicircular standard receiving surface 42, 48. The radius of the standard receiving surface 42, 48 substantially corresponds to the diameter of a standard 12. The substantially semicircular standard receiving surface 42, 48 defines a standard receiving space 50 having a central axis A which, with the coupling 30 in a condition coupled to a standard 12, substantially corresponds to the standard central axis $L_s$. Together with the foot 32, the coupling hook 44 defines a standard inlet 52 via which a standard 12 can be introduced into the standard receiving space 50. The coupling 30 further comprises a locking element 54 which is connected hingedly about a pivot 56 to the coupling hook 44. The pivot 56 is parallel to the central axis A of the standard receiving space 50. The locking element 54 has a locking position in which the standard inlet 52 is blocked by the locking element 54. The locking element 54 further has a releasing position in which the standard inlet 52 is released for letting a standard into or taking it out of a standard receiving space 50. The coupling 30 further comprises a wedge 58 which is slideably connected to the coupling hook 44 and which, in a securing position, engages the locking element 54 and holds this locking element 54 in the locking position.

The coupling 30 is not only suitable for use on a first ledger 14, 14', 38, 38' and a second ledger 24, 24', but is also eminently suitable for use on diagonal tubes (not shown). Diagonal tubes are always used in scaffolding systems and serve for providing the required robustness to the scaffolding. With the diagonal tubes in mounted condition, the couplings 30 that are provided on the diagonal tubes can for instance engage the first or second ledgers 14, 14', 24, 24'.

In one embodiment, of which an example is shown in FIGS. 2-10, the coupling 30 comprises a first wedge recess 60 in the coupling hook 44 adjacent the second end 62 of the coupling hook 44 which is remote from the first extremity 46 of the coupling hook 44 connected to the foot 32. The wedge 58 is slideably but not removably received in the wedge recess 60. Such a design has as an advantage that when mounting a scaffolding, the wedge 58 cannot come loose from the coupling 30, so that it is always at hand. Furthermore, the wedge falling on a bystander or a fellow scaffolding builder is thus prevented. Moreover, striking the wedge 58 into place allows a rapid connection of a ledger 38 to a standard 12. The uncoupling of a ledger 38 can be realized rapidly too by knocking the wedge 58 loose.

In one exemplary embodiment, the coupling 30 can comprise a second wedge recess 66 which is provided in the coupling hook 44 adjacent the first extremity 46. The second wedge recess 66 is configured for allowing the passage of a wedge 58' of a second, corresponding coupling 30' of a second ledger 38' which is connected at the same level to the standard 12. It is highly advantageous when ledgers 38, 38' can be connected to a standard 12 at the same level, because then, floor parts that are placed on the ledgers 38, 38' may extend at the same level. This is highly beneficial to safety.

In one embodiment, of which, again, an example is shown in the Figures, the locking element 54 can have, on a side proximal to the standard receiving space 50, a substantially circular segmental locking support surface 68. Here, an imaginary center of the circular segmental locking support surface 68 preferably substantially coincides with the central axis A of the standard receiving space 50. In the exemplary embodiment shown, the locking element is designed such that it automatically enters into the locking position when a standard 12 is pressed completely into the standard receiving space 50. By striking the wedge 58, only the securing of the locking element 54 in this locking position is realized. This effect is obtained in that the locking element 54 extends on two sides of the pivot 56, while both sides can engage on a standard 12.

In one embodiment, of which an example is shown in FIGS. 2-10, the foot 32 of the coupling 30 can comprise a foot ring 70 on the first side 34 of the foot 32. The foot 32 can further comprise two foot wings 72 lying opposite each other which are each provided, on a side remote from the foot ring 70, with a foot support surface 42. With such a design, the first extremity 46 of the coupling hook 44 can be connected to the foot ring 70 and the two foot wings 72. Between the two foot wings 72, a hook receiving space is formed in the foot 32 which provides a receiving possibility for a coupling hook 44' of a second, corresponding coupling 30' of a second ledger 38' which is connected to the standard 12 at the same level.

In one embodiment, which is preferred from a point of view of production and rigidity and strength, the foot 32 and the coupling hook 44 are designed integrally as one single casting.

The coupling 30 described hereinabove with reference to FIGS. 2-10 is particularly suitable for a scaffolding system 10 according to the invention. The present invention does not only concern the scaffolding system 10 but also a coupling 30 intended for such a scaffolding system. The invention further relates to a ledger 14, 24, 38, 38' intended for a scaffolding system 10 as described hereinabove where the ledger is fixedly connected at at least one extremity thereof with the first side 34 of the foot 32 of the above described ledger coupling 18, 28, 30, 30'.

The invention further relates to a standard 12 which can be intended for a scaffolding system 10 as described hereinabove. As already indicated hereinabove, such a standard 12 has an imaginary standard longitudinal central axis $L_s$ and it is further provided with supporting projections 20 which, viewed in the direction of the standard longitudinal central axis $L_s$, are provided at regular distances on the outside surface of the standard 12.

In one embodiment, the standard can then further comprise orientation projections 22 which, viewed in the direction of the standard longitudinal central axis $L_s$, are provided at regular distances on the outside surface of a standard 12 and which are each associated with an associated supporting projection 20.

As already noted hereinabove, such a standard 12 can be of light design because the projections hardly if at all add weight to the standards 12. As a result, the supporting projections 20 and the optional orientation projections 22 can be provided at a relatively limited distance viewed in the direction of the longitudinal central axis $L_s$ of the standard 12. Thus, a great flexibility is obtained with respect to the levels on which ledgers 14, 24 can be connected to a standard 12. FIG. 11 shows by way of further illustration a node of the scaffolding system 10 with two first ledgers 14, 14' which are in line with each other. FIG. 12 shows a node of a scaffolding system 10 provided with two first ledgers 14, 14' and two second ledgers 24, 24'. Clearly visible is that the first ledger couplings 18, 18' rest on the supporting projections 20. The second ledger couplings 28, 28', in turn, rest on the first ledger couplings 18, 18'.

Such standards 12 can also be advantageously utilized for scaffolding systems where the ledgers 14 are not provided with ledger couplings 18 at their extremities, but where the ledgers are connected to the standards by cross connections. As the cross connections can rest on the supporting projections 20, the joint between a standard and a ledger does not depend just on the clamping force the cross connection exerts on the standard 12. As a result, considerable lighter cross connections can suffice. Instead of cross connections having a weight in the order of 1 kg, cross connections with a weight in the order of 200-500 g can suffice.

Figure 13:
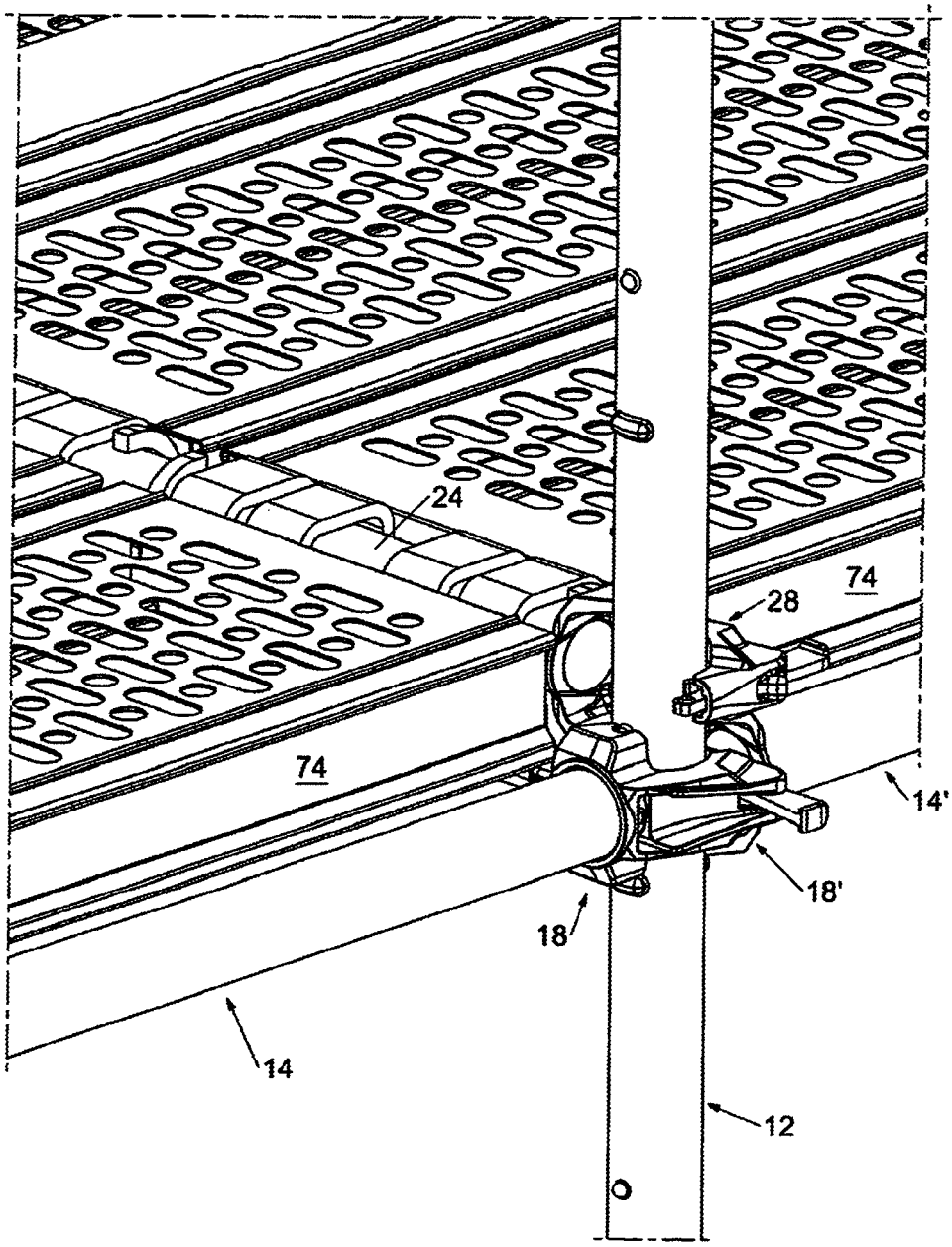
FIG. 13 shows a node of a standard with two first ledger tubes and a second ledger and floor parts.

Finally, FIG. 13 shows a node with two first ledgers 14, 14' and a second ledger 24. On the second ledger 24, floor parts 74 are placed.

Although the invention is represented in detail and described with reference to the drawings, these drawings and the description should only be considered to serve as example. The invention is not limited to the described embodiments. For instance, in an alternative embodiment, the supporting projections 20 and the optional orientation projections 22 may also have been provided on the standards 12 through a welding operation. However, it is preferred to provide projections through plastic deformation because this does not lead to any weight increase and furthermore does not require additional finishing operations that may be required when welding because of internal stresses introduced by the welding process into the steel tubing. Other finishing operations such as, for instance, an anti-corrosion treatment, such as for instance galvanizing, can also be omitted with projections provided through plastic deformation or be carried out less intensively than when projections are provided with the aid of a welding operation. Characteristics that are described in the subclaims can be combined with each other. Reference numerals in the claims should not be construed to be limitations of the claims but serve merely as clarification.

The invention claimed is:

1. A scaffolding system comprising a plurality of standards, each having:

a cylindrical tube wall having a standard longitudinal central axis;

a plurality of supporting projections provided on the outside surface of said standard at regular distances corresponding to lengths along the standard longitudinal central axis, wherein the supporting projections are formed through plastic deformation of the tube wall;

a plurality of orientation projections provided on the outside surface of said standard at regular distances corresponding to lengths along the standard longitudinal central axis, and associated with the supporting projections, wherein the orientation projections are formed through plastic deformation of the tube wall;

the scaffolding system further comprising a plurality of first ledgers, each having:

a first ledger longitudinal central axis and two first ledger extremities, each of said first ledger extremities being connected to a respective, first ledger coupling, wherein each of the first ledger couplings has a first ledger orientation recess, and wherein the first ledger couplings are configured for connecting to respective ones of the plurality of standards, by resting on respective ones of said plurality of supporting projections, and simultaneously also by reception of respective ones of said plurality of orientation projections in respective ones of said plurality of orientation recesses, to determine rotational positions of said first ledger couplings about the standard longitudinal axis.

2. The scaffolding system according to claim 1, further comprising a plurality of second ledgers, each having:

a second ledger longitudinal central axis and two second ledger extremities, each of said second ledger extremities being connected to a respective, second ledger coupling, wherein the second ledger couplings are configured for connecting to respective ones of said plurality of standards by resting on respective ones of the first ledger couplings.

3. The scaffolding system according to claim 2, wherein the first ledger couplings are of the same design as the second ledger couplings.

4. The scaffolding system according to claim 2, wherein the first ledgers extend in a same first direction and the second ledgers extend in a same second direction, wherein said first direction is different from said second direction.

5. The scaffolding system according to claim 1, wherein the first ledger couplings are designed such that two first ledgers can be connected at the same level to one joint standard such that the longitudinal central axes of the two first ledgers are in line with each other.

6. A scaffolding system comprising: at least one standard, wherein the at least one standard includes:

a cylindrical tube wall having a standard longitudinal central axis and defining a cylindrical outer surface of the standard;

supporting projections provided on the outer surface of said standard at regular distances corresponding to lengths along the standard longitudinal central axis, wherein the supporting projections are formed through plastic deformation of the tube wall;

orientation projections provided on the outer surface of said standard at regular distances corresponding to lengths along the standard longitudinal central axis, and associated with the supporting projections, wherein the orientation projections are formed through plastic deformation of the tube wall;

a ledger coupling comprising:

a foot having a first side designed for fixed connection to an extremity of a ledger associated with the coupling, and a second side opposite the first side forming a foot support surface for abutment against the cylindrical outer surface of the standard;

a coupling hook connected by a first end to the foot and forming a coupling hook support surface which together with the foot support surface defines a substantially semicircular standard receiving surface with a radius which substantially corresponds to the diameter of the cylindrical outer surface of the standard, the substantially semicircular standard receiving surface defining a standard receiving space which has a central axis which, when the coupling is mounted to a standard, substantially coincides with the central axis of the standard, wherein the coupling hook together with the foot defines a standard inlet via which the standard can be introduced into the standard receiving space;

a wedge which is slideably connected to the coupling hook;

a first wedge recess in the coupling hook in which the wedge is slideably but not removably received; and at least one orientation recess that is included in the semicircular standard receiving surface and that is configured to receive a respective one of said orientation projections of the standard, wherein reception of said orientation projection of the standard in the orientation recess of said semicircular standard receiving surface determines a rotational position of the ledger coupling about the standard central axis.

7. The scaffolding system according to claim 6, further comprising:

a locking element which is connected hingedly about a pivot to the coupling hook, wherein the pivot is parallel to the central axis of the standard receiving space, wherein the locking element has a locking position in which the standard inlet is blocked by the locking element, and wherein the locking element has a releasing position in which the standard inlet is released for letting a standard into or taking a standard out of the standard receiving space, the locking element on a side proximal to the standard receiving space having a substantially circular segmental locking support surface, having a center that substantially coincides with the central axis of the standard receiving space.

8. The scaffolding system according to claim 6, wherein the foot comprises:

a foot ring on the first side of the foot;

two foot wings lying opposite each other on the second side of the foot, wherein the first end of the coupling hook is connected to the foot ring and the two foot wings, and wherein between the foot wings a hook receiving space is formed in the foot which is configured for receiving a coupling hook of a second, corresponding coupling of a second ledger which is connected at the same level to a standard.

9. The scaffolding system according to claim 6, wherein the foot and the coupling hook are integrally designed as a single casting.

10. The scaffolding system of claim 6, in combination with a ledger that is fixedly connected at an extremity thereof to the first side of the foot of the ledger coupling.

11. The scaffolding system according to claim 6, wherein the at least one orientation recess is in the foot support surface in the standard receiving surface.

* * * * *